US010643804B2

(12) United States Patent
Chen

(10) Patent No.: US 10,643,804 B2
(45) Date of Patent: May 5, 2020

(54) AUTOMATIC POWER TRANSFER SWITCHING MECHANISM

(71) Applicant: Chau Tsung Chen, New Taipei (TW)

(72) Inventor: Chau Tsung Chen, New Taipei (TW)

( * ) Notice: Subject to any disclaimer, the term of this patent is extended or adjusted under 35 U.S.C. 154(b) by 0 days.

(21) Appl. No.: 16/056,207

(22) Filed: Aug. 6, 2018

(65) Prior Publication Data

US 2019/0304713 A1 Oct. 3, 2019

(30) Foreign Application Priority Data

Apr. 3, 2018 (TW) ..... 107111983 A

(51) Int. Cl.
*H01H 9/26* (2006.01)

(52) U.S. Cl.
CPC ..... *H01H 9/26* (2013.01); *H01H 2300/018* (2013.01)

(58) Field of Classification Search
CPC ..... H01H 9/26; H01H 2300/018
USPC ..... 200/50.32–50.35, 50.37–50.4
See application file for complete search history.

(56) References Cited

U.S. PATENT DOCUMENTS 6,521,849 B1 * 2/2003 Flegel ..... H01H 9/26 200/50.32
7,126,068 B2 * 10/2006 Fillppenko ..... H01H 9/26 200/50.33

* cited by examiner

*Primary Examiner* — Edwin A. Leon
*Assistant Examiner* — Lheiren Mae A Caroc

(57) ABSTRACT

An automatic power transfer switching mechanism includes several links and a push member. The links move to rotate the push member. The push member has two push portions configured to push two power switches. The push member is rotatable about a first axis located between the two push portions so that when one of the push portion moves forwards, the other push portion moves backwards. Therefore, when one push portion moves forward to push one power switch on, the other push portion moves backwards to simultaneously push the other power switch off. The power transfer can be switched automatically without delay.

19 Claims, 8 Drawing Sheets

AUTOMATIC POWER TRANSFER SWITCHING MECHANISM

BACKGROUND OF THE INVENTION

Field of the Invention

The invention relates to an automatic power transfer switching mechanism, and more particularly to an automatic power transfer switching mechanism utilizing a link mechanism for switching one power switch on and switching another power switch off simultaneously.

Description of the Related Art

An automatic transfer switch is a switching device that is configured to connect one power supply to an electrical network and disconnect another power supply from the electrical network simultaneously so that only one of power supplies is connected to the electrical network for supply of electrical power. The automatic transfer switch is mounted in a building having an electrical network and includes two power switches. One of the power switches is connected to a power supply of an electrical power company (regular power supply), and the other power switch is connected to a power generator (spare power supply). When the building has a fire or other accident causing failure of the electrical power supply, the automatic transfer switches will automatically switch on the power switch connecting to the power generator and switch off the power switch connecting to the power supply of the electrical power company so that the power generator may still provide electrical power for water pumps used for fire suppression and elevators in the building until the power supply from electrical power company is restored. When the power supply from the electrical power company is restored, the automatic transfer switch will automatically simultaneously switch on the power switch connecting to the power supply of the electrical power company and switch off the power switch connecting to the electrical power generator. Therefore, electrical power is continuously provided for the electrical network of the building.

Referring to FIG. 1, a conventional automatic transfer switch is shown. The conventional automatic transfer switch includes a power switch S1 connected to a power supply of an electrical power company and a power switch S2 connected to a power generator. The conventional automatic transfer switch includes two push members P1 and P2, and an active gear 1 and two following gears 2 are used to move the push members P1 and P2. The active gear 1 meshes with the following gears 2. Each of the following gears 2 has a cam C disposed on a lateral side of the following gear 2. Each of the push members P1 and P2 has a cam slot B engaging the cam C. When the active gear 1 is rotated by a motor or a rotatable rod R, the following gears 2 are rotated by the active gear 1, and the cam C is rotated with the following gear 2 and moves in the cam slot B so that the push members P1 and P2 are moved by the cam C to push the power switches S1 and S2 so as to switch the power switches S1 and S2 on or off. The positions of the cams C on the following gears 2 are appropriately arranged in a manner that when the push member P1 switches the power switch S1 on, the push member P2 switches the power switch S2 off, or vice versa. In addition, the indication of the switch on and off utilizes stickers of red and green colors attached onto the following gears 2, and the housing S has two windows W1 and W2. When the power switch S1 or S2 is switched on, the following gears 2 rotate to a position where the green stickers align with the windows W1 or W2. When the power switch S1 or S2 is switched off, the following gears 2 rotate to a position where the red stickers align with the windows W1 or W2. Therefore, a user can view the windows W1 and W2 to know which power switch S1 or S2 is switched on or off by way of the red and green stickers appearing in the windows W1 and W2.

However, since the conventional automatic transfer switch uses the active gear 1 and the following gears 2, the switching of the power switches S1 and S2 are often delayed and cannot be simultaneous due to gaps between teeth of the active gear 1 and the following gears 2 and the opposite rotational directions of the active gear 1 and the following gears 2. In addition, as the active gear 1 and the following gears 2 are often made from plastic, the active gear 1 and the following gears 2 may be damaged due to aging problems and must be replaced after they have been used for a certain period of time. Because the indication of switching on or off is through observation of red or green stickes appearing in the windows W1 or W2, such an indication is not easily noticed and realized, and if the red or green sticker falls off the following gears 2 due to humidity, the indication will fail.

BRIEF SUMMARY OF THE INVENTION

An object of the invention is to provide an automatic power transfer switching mechanism using a link set to rotate a push member having two push portions formed at two ends thereof with respect to a first axis located between the push portions so that one of the push portions moves forwards and the other push portion moves backwards simultaneously so as to switch one power switch on and switch the other power switch off simultaneously. The link set of the invention may be made from stainless steel, which is able to resist corrosive environments and is not easily aged or to get rusted.

The automatic power transfer switching mechanism in accordance with an exemplary embodiment of the invention includes a frame, a first power switch configured to connect or disconnect the first power supply to an electrical network, a second power switch configured to connect or disconnect the second power supply to the electrical network, a push member rotatably disposed on the frame and rotatable with respect to a first axis, wherein the push member includes a first push portion and a second push portion, and the first axis is located between the first push portion and the second push portion, a linking mechanism connected to the push member, and a first driving source connected to the linking mechanism and rotating the push member about the first axis so as to move the first push portion to push a first power switch along a first direction and move the second push portion to push a second power switch along a second direction opposite to the first direction.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein:

FIG. 7 depicts an indicating member protruding from a frame when the power generator is turned on.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
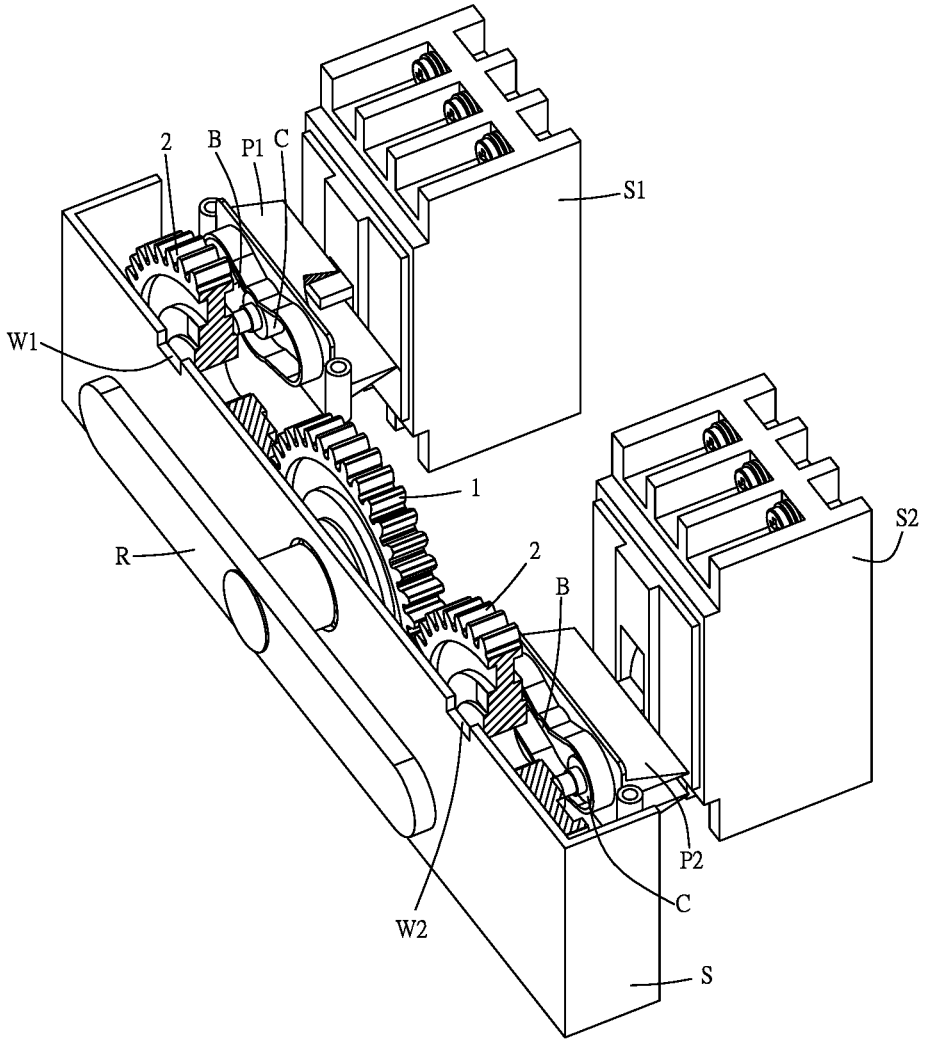
Fig. 1(Prior Art)
FIG. 1 is a perspective view of a conventional automatic transfer switch.
Figure 2:
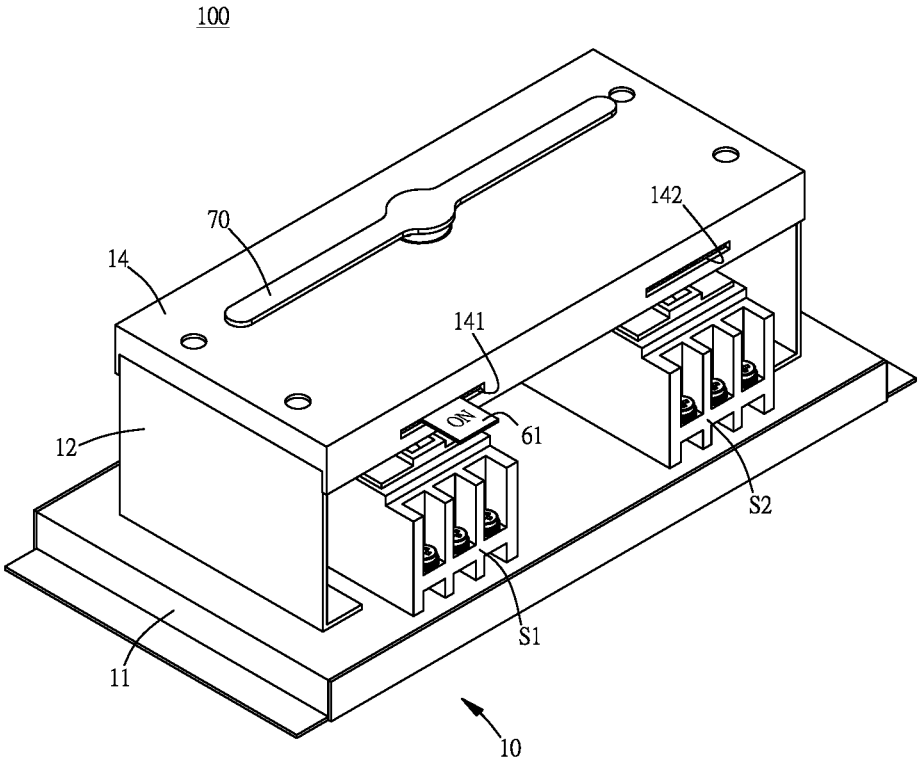
FIG. 2 is a perspective view of an embodiment for an automatic power transfer switching mechanism.
Figure 3:
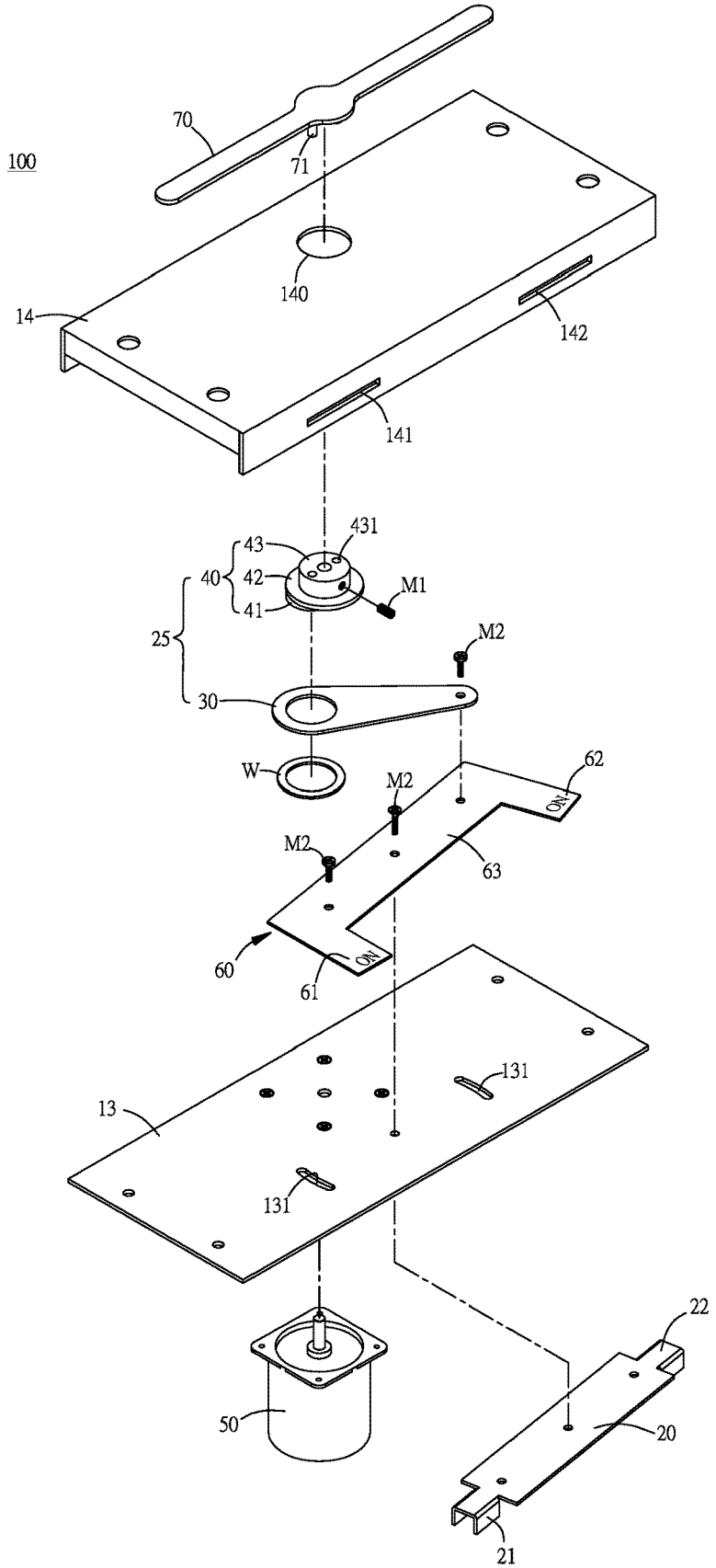
FIG. 3 is a perspective exploded view of the automatic power transfer switching mechanism of FIG. 2.
Figure 4:
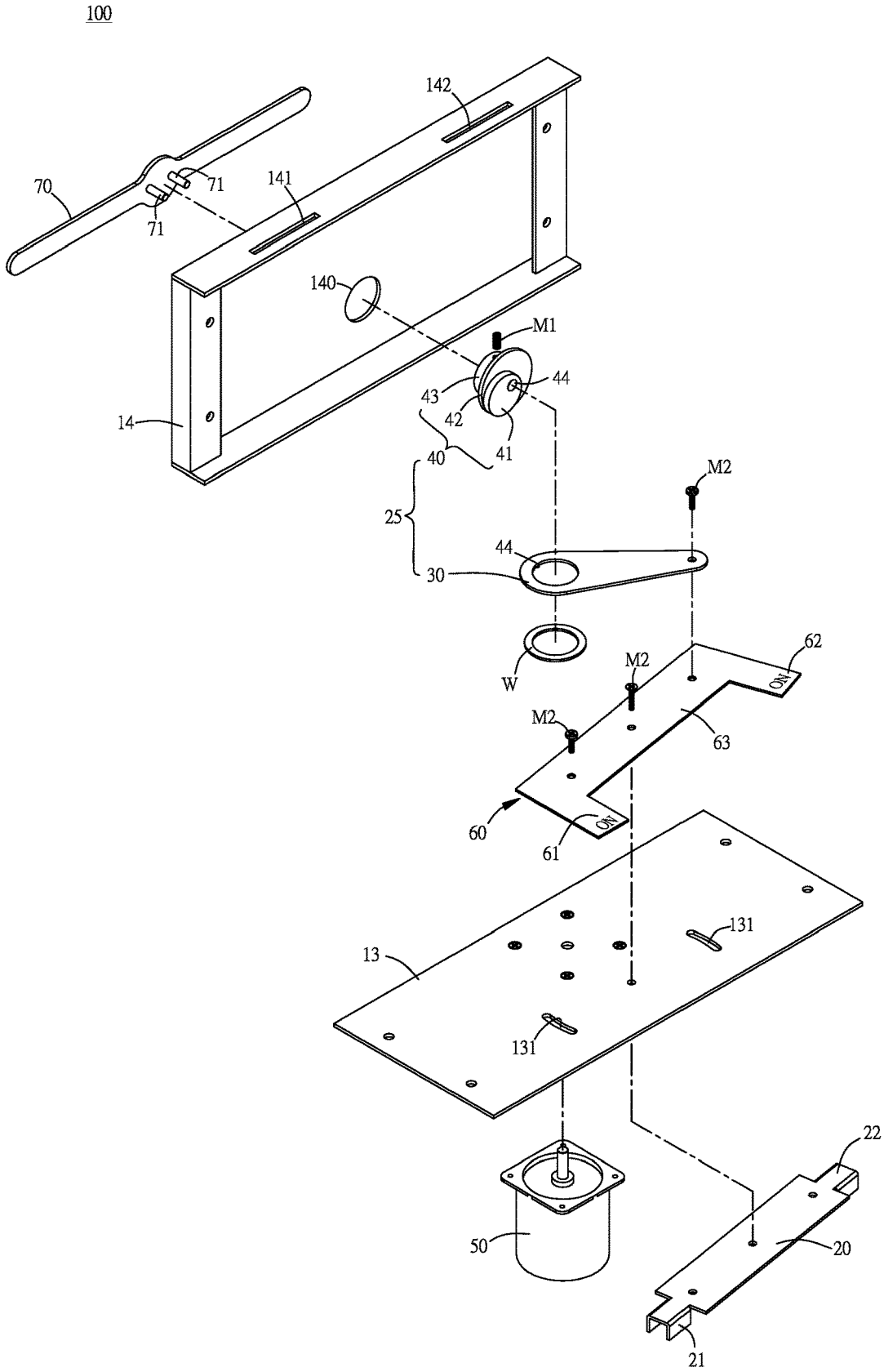
FIG. 4 is another perspective exploded view of the automatic power transfer switching mechanism of FIG. 2.

Referring to FIGS. 2, 3 and 4, an embodiment automatic power transfer switching mechanism 100 is used to selectively connect a first power supply or a second power supply to an electrical network. The electrical network is exemplarily the network of all electrical and electronic devices in a building. The first power supply is exemplarily a power supply from the electrical power company. The second power supply is exemplarily a power supply from a power generator. The automatic power transfer switching mechanism 100 includes a frame 10, a first power switch S1, a second power switch S2, a push member 20, a linking mechanism 25, a first driving source 50, an indicating member 60 and a second driving source 70. The first power switch S1 connects a first power supply to the electrical network, and the second power switch S2 connects a second power supply to the electrical network.

The frame 10 includes a base 11, two lateral frames 12, a loading plate 13 and a top cover 14. The lateral frames 12 are U-shaped. One arm of the lateral frame 12 is fixed to the base 13 by way of bolts, and two lateral frames 12 are opposingly disposed and spaced by a distance. The loading plate 13 is placed across the lateral frames 12 and fixed to the other arm of the lateral frame 12 so that a first accommodating space is formed among the two lateral frames 12 and the loading plate 13. The first power switch S1 and the second power switch S2 are fixed to the base 11 and located in the first accommodating space between the lateral frames 12. Because the push member 20 is used to push the first power switch S1 and the second power switch S2, the push member 20 is also located in the first accommodating space. The first driving source 50 is also in the first accommodating space and fixed to a bottom surface of the loading plate 13. The top cover 14 is fixed to the loading plate 13, and a second accommodating space is formed between the top cover 14 and the loading plate 13. The linking mechanism 25 and the indicating member 60 are located in the second accommodating space and loaded on a top surface of the loading plate 13. The second driving source 70 is disposed externally to the top cover 14 and detachably joined to the linking mechanism 25 (a second link 40). The structures and connections of the elements are described in the following paragraphs.

The first power switch S1 is used to connect or disconnect the first power supply to an electrical network, and the second power switch S2 is used to connect or disconnect the second power supply to the electrical network. In this embodiment, the first power supply is the power output of the power company, and the second power supply is a power generator. In addition, the first power switch S1 and the second power switch S2 are not circuit breakers.

Figure 6:
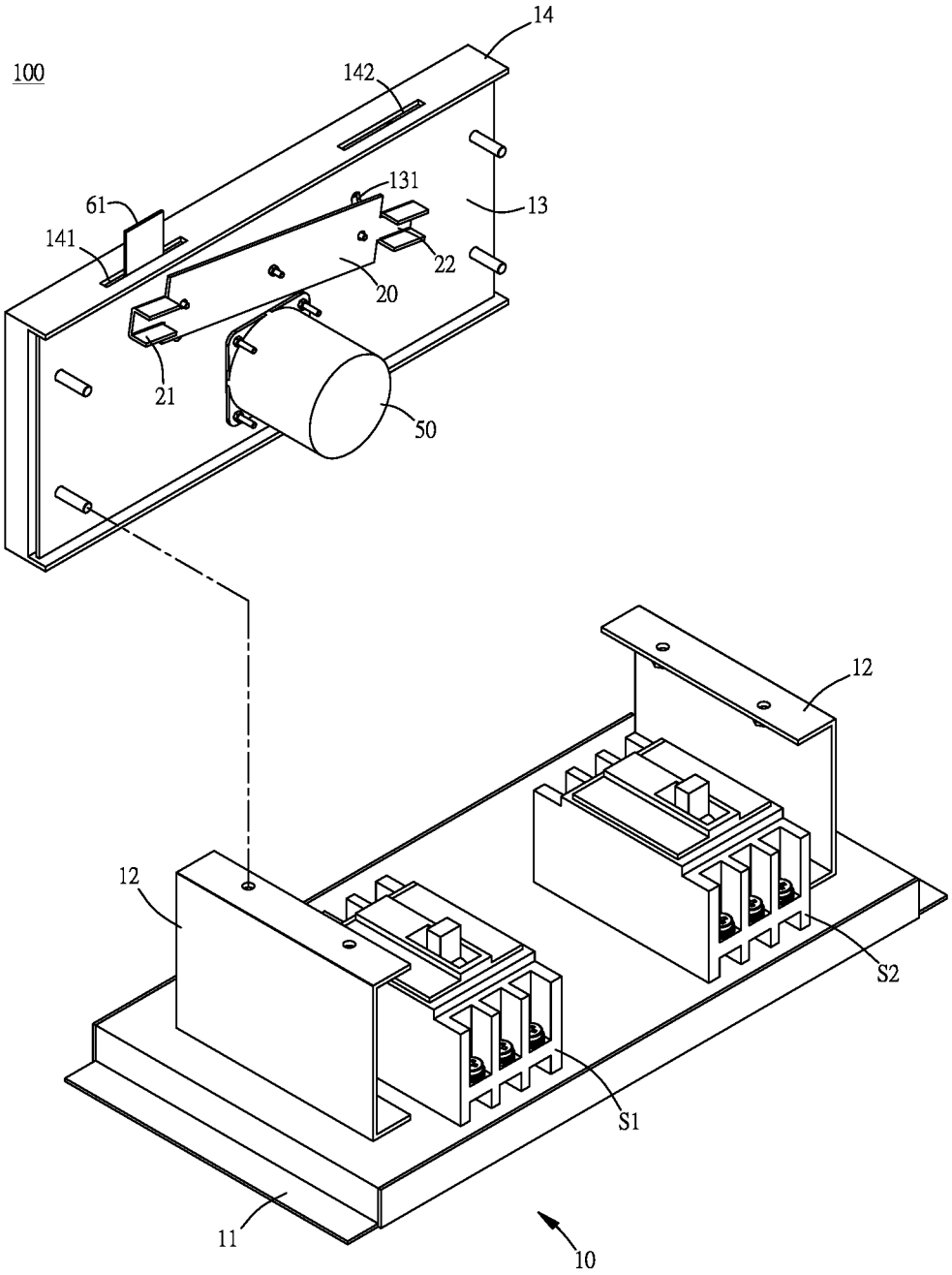
FIG. 6 is a partial exploded view of the automatic power transfer switching mechanism of FIG. 2.

The push member 20 is rotatably mounted on the frame 10 and rotatable with respect to a first axis L1 (see FIG. 6). In this embodiment, the push member 20 is rotatably mounted to the bottom surface of the loading plate 13. The first axis L1 is perpendicular to the loading plate 13. The push member 20 includes a first push portion 21 and a second push portion 22. The first axis L1 is located between the first push portion 21 and the second push portion 22. In this embodiment, the push member 20 is a rod, and the first push portion 21 and the second push portion 22 are formed at two ends of the rod. Therefore, since the rod is rotated with respect to the first axis L1 located between the first push portion 21 and the second push portion 22, the second push portion 22 moves backwards when the first push portion 21 moves forwards. The first push portion 21 and the second push portion 22 are depressions which easily engage the paddles of the first power switch S1 and the second power switch S2. When the push member 20 rotates about the first axis L1 and the first push portion 21 move forward to push the paddle of the first power switch S1 forward, the second push portion 22 moves backward to push the paddle of the second power switch S2 backward, or vice versa. Therefore, when the first power switch S1 is switched on, the second power switch S2 is switched off, or when the first power switch S1 is switched off, the second power switch S2 is switched on.

The linking mechanism 25 includes a first linking member 30 and a second linking member 40. The first linking member 30 is rotatably connected to the push member 20. The second linking member 40 is rotatably connected to the first linking member 30. The first driving source 50 is connected to the second linking member 40 and drives the second linking member 40 to rotate about a second axis L2 so that the first linking member 30 moves the push member 20 to rotate about the first axis L1. The first push portion 21 pushes the first power switch S1 along a first direction (for example forwards), and the second push portion 22 push the second power switch S2 along a second direction (for example backwards). The first direction is opposite to the second direction. As described in the previous paragraph, the first push portion 21 moves forward to push the paddle of the first power switch S1 forward, and the second push portion 22 moves backward to pull the paddle of the second power switch S2 backward simultaneously, or vice versa. In this embodiment, the first driving source 50 is an electrical motor controlled by a control circuit or a controller to rotate the second linking member 40 about the second axis L2.

In this embodiment, the second linking member 40 includes an eccentric wheel 41. The first linking member 30 rotatably holds on an outer periphery of the eccentric wheel 41. The center of the eccentric wheel 41 is spaced from the second axis L2. The first driving source 50 rotates the eccentric wheel 41 about the second axis L2 (see FIGS. 4 and 5). Therefore, the center of the eccentric wheel 41 rotates about the second axis L2. The second linking member 40 further includes a main body 42 and a fixing portion 43. The fixing portion 43 and the eccentric wheel 41 are disposed on opposite sides of the main body 42, and the second driving source 70 is joined to the fixing portion 43. Two holes 431 are formed on a top of the fixing portion 43, and the second driving source 70 is joined to the holes 431.

The detailed structure is described in the following paragraphs. Referring to FIGS. 3 and 4, in this embodiment, the main body 42 is disc-shaped and has two end surfaces formed in an axial direction of the main body 42. The fixing portion 43 is cylindrical, and a through hole 44 is formed in the second linking member 40. The through hole 44 extends through the eccentric wheel 41, the main body 42 and the fixing portion 43. The through hole 44 has an axial direction coinciding with the second axis L2. An output shaft of the electrical motor (the first driving source 50) is inserted into the through hole 44 and positioned in the through hole 44 by way of a positioning bolt M1, whereby the first driving source 50 rotates the second linking member 40 about the second axis L2 when the output shaft of the first driving source 50 rotates.

The first linking member 30 is a link with one end holding the outer periphery of the second linking member 40 and the other end pivoted to the push member 20. In this embodiment, the pivot position of the first linking member 30 and the push member 20 is located between the first push portion 21 and the first axis L1. Therefore, one end of the first linking member 30 is rotated about the second axis L2 along with the eccentric wheel 41 so that the first linking member 30 is moved forwards and backwards. Therefore, the first linking member 30 pulls and pushes the push member 20 to rotate about the first axis L1 so that the first push portion 21 and the second push portion 22 have the described simultaneous forward and backward movements. In another embodiment, a bearing is mounted between the outer periphery of the eccentric wheel 41 and the first linking member 30.

Figure 5:
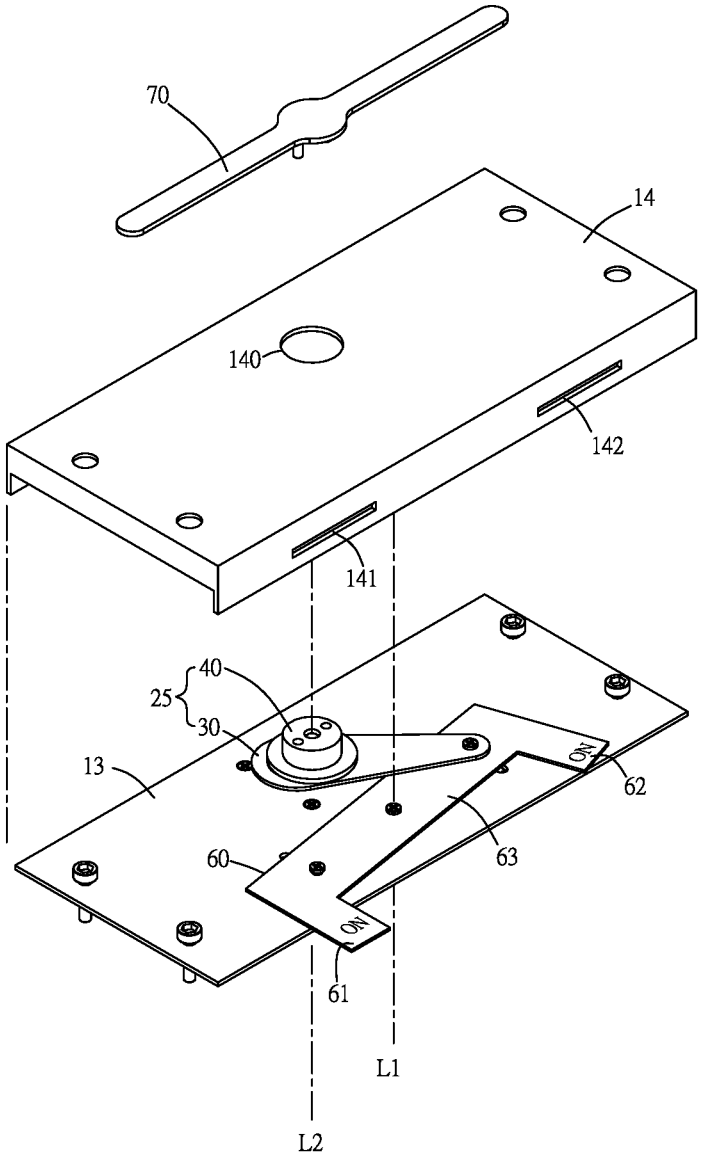
FIG. 5 is a partial exploded view of a portion of elements of the automatic power transfer switching mechanism of FIG. 2.

Referring to FIGS. 4 and 5, in this embodiment, the indicating member 60 is fixed to the push member 20 through fasteners M2 so that the indicating member 60 is rotated about the first axis L1 along with the push member 20. In this embodiment, the fasteners M2 are bolts and nuts. In this embodiment, the other end of the first linking member 30 is pivoted to the indicating member 60. Since the indicating member 60 has a predetermined thickness, a washer W is placed beneath the connection position of the first linking member 30 and the eccentric wheel 41, whereby two ends of the first linking member 30 are at the same height, and the movement of the first linking member 30 is thus smooth. In addition, in this embodiment, the pivot position of the first linking member 30 and the indicating member 60 coincides the connection position of the push member 20 and the indicating member 60. The fastener M2 pivots the first linking member 30 to the indicating member 60 as well as fixing the indicating member 60 to the push member 20. Because the indicating member 60 is located on the top surface of the loading plate 13, the push member 20 is located on the bottom surface of the loading plate 13, and the fasteners M2 extends through the indicating member 60 and the push member 20. Vertically, curved grooves 131 are formed on the loading plate 13 to allow the fasteners M2 pass through the loading plate 13. When the indicating member 60 and the push member 20 rotate about the first axis L1, the fasteners M2 move in the curved grooves 131. Preferably, the length of the curved groove 131 is greater than the maximal stroke of the push member 20 and the indicating member 60 moved by the first linking member 30.

The indicating member 60 includes a first indicating end 61, a second indicating end 62 and a main body 63. The first indicating end 61 corresponds to the first push portion 21, and the second indicating end 62 corresponds to the second push portion 22. In this embodiment, the main body 63 is a rod, and the first indicating end 61 and the second indicating end 62 are connected to two ends of the main body 63 to form a U-shaped element. The indicating member 60 is fixed to the push member 20 by way of bolts. The position of the first indicating end 61 corresponds to the position of the first push portion 21, and the position of the second indicating end 62 corresponds to the position of the second push portion 22. Therefore, when the first push portion 21 pushes the first power switch S1 to connect the first power supply to the electrical network, the first indicating end 61 moves forwards along with the first push portion 21. Two slots 141 and 142 are formed on a lateral side of the top cover 14. When the first indicating end 61 moves forwards, the first indicating end 61 passes through the slot 141 to protrude from the top cover 14. At the same time, the second indicating end 62 moves backwards along with the second push portion 22 to be hidden in the top cover 14. Therefore, when a user views the protruding first indicating end 61, he/she may realize that the first power supply is connected (ON). Similarly, when the second push portion 22 pushes the second power switch S2 to connect the second power supply to the electrical network, the second indicating end 62 moves forwards along with the second push end 22 to pass through the slot 142 and protrude from the top cover 14, and the first indicating end 61 is hidden in the top cover 14, whereby it is indicated that the second power supply is connected to the electrical network (ON). In addition, the first indicating end 61 and the second indicating end 62 are angled with respect to the main body 63 so that the first indicating end 61 and the second indicating end 62 are perpendicular to the top cover 14 when the first indicating end 61 and the second indicating end 62 protrude from the top cover 14.

Figure 7:
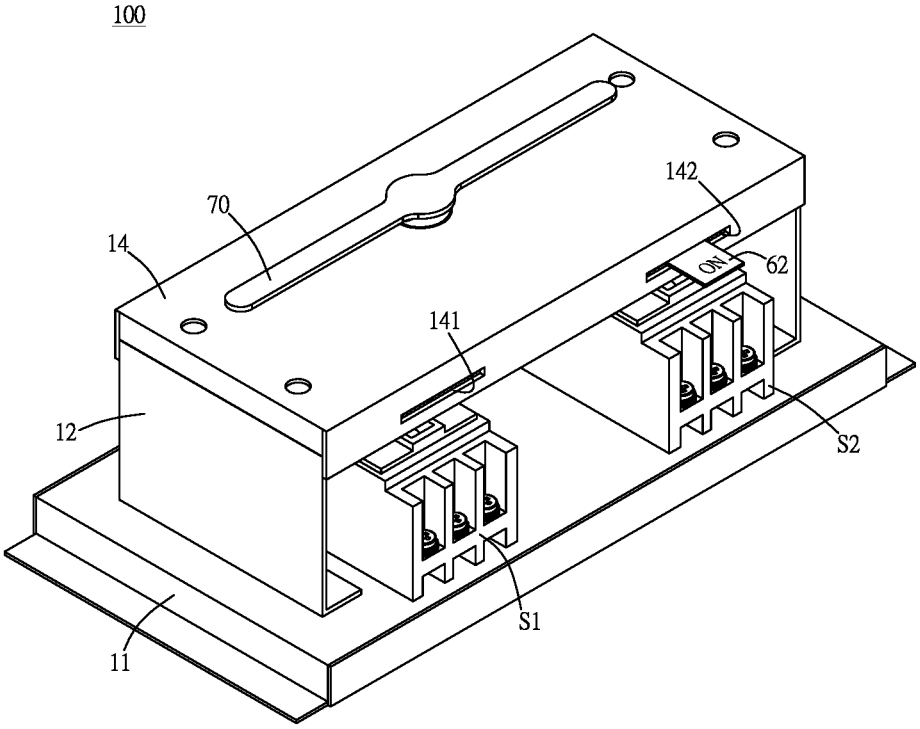

When the first power supply stops providing electrical power (for example a fire accident or another accident occurs), the control circuit or the controller controls the first driving source 50 to rotate the second linking member 40 about the second axis L2 so as to move the first linking member 30 and push the push member 20 to rotate about the first axis L1. The push member 20 rotates about the first axis L1 so that the first push portion 21 moves backwards to pull the first power switch S1 backwards and switch the first power switch S1 off, and the second push portion 22 moves forward to push the second power switch S2 forward and switch the second power switch S2 on. Therefore, the electrical power is provided to the electrical network by the second power supply (electrical power generator), and the second indicating end 62 of the indicating member 60 protrudes from the frame 10 as shown in FIG. 7. When the event is over and the first power supply is able to provide electrical power again, the control circuit or the controller controls the first driving source 50 to rotate the second linking member 40 about the second axis L2 so as to move the first linking member 30 and push the push member 20 to rotate about the first axis L1. The first push portion 21 pushes the first power switch S1 forward to switch the first power switch S1 on, and the second push portion 22 pushes the second power switch S2 backwards to switch the second power switch S2 off simultaneously. Therefore, the electrical power is provided to the electrical network by the first power supply (the power company) again, and the first indicating end 61 of the indicating member 60 protrudes from the frame 10 as shown in FIG. 2.

Figure 8:
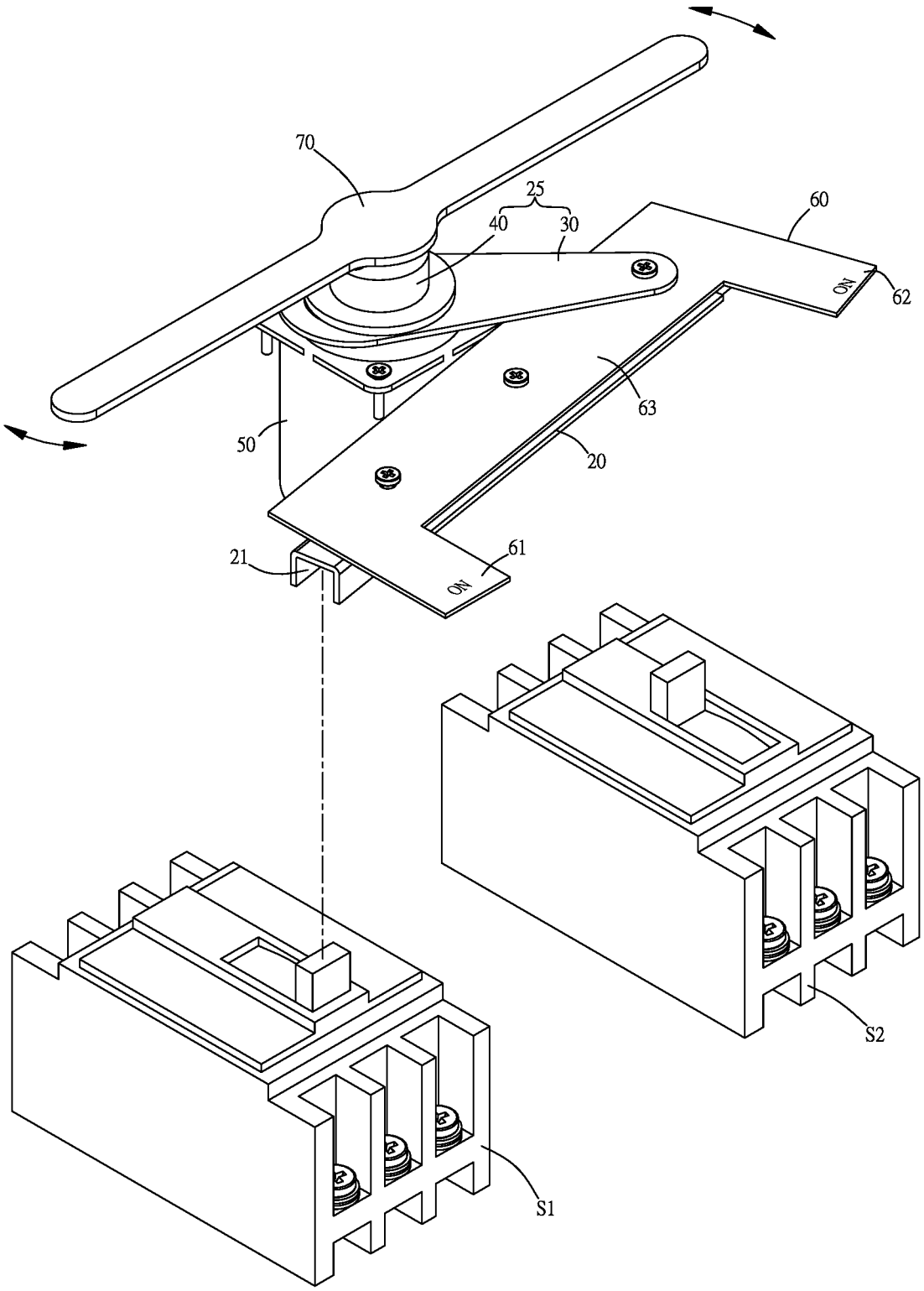
FIG. 8 depicts a second driving source (rotatable rod) rotating the push member.

Referring to FIG. 8, the second driving source 70 drives the second linking member 40 so as to move the first linking member 30 and rotate the indicating member 60 and the push member 20. In this embodiment, the second driving source 70 is a rotatable rod having two posts 71 at the center of the rotatable rod (please see FIGS. 3 and 4). The second driving source 70 is joined to the second linking member 40 through the posts 71 inserted into the hole 431 of the fixing member 43. A user may rotate the second driving source 70 to rotate the second linking member 20 about the second axis L2. The second driving source 70 is provided for a user to operate the automatic power transfer switching mechanism 100 manually to test whether the automatic power transfer switching mechanism 100 is in a normal condition. The second driving source 70 is joined to the second linking member 40 when the test is performed. The second driving source 70 is detached from the second linking member 40 when it is not used to prevent other individuals from operating the second driving source 70 accidentally. In addition, the top of the fixing member 43 is at the same height as the top of the top cover 14 for the sake of aesthetics.

The automatic power transfer switching mechanism 100 utilizes the push member 20, which is rotatable about the first axis L1 located between the first push portion 21 and the second push portion 22. When the first push portion 21 moves forward, the second push portion 22 move backwards. Therefore, when the paddle of the first power switch S1 is moved forward, the paddle of the second power switch S2 is moved backwards, which carries out the simultaneous switching of the first power switch S1 and the second power switch S2 without any delays. In addition, the elements of the automatic power transfer switching mechanism 100 are made from stainless steel, which extends the service life of the elements. Because the automatic power transfer switching mechanism 100 utilizes the indicating member 60, the protrusion of the first indicating end 61 or the first indicating end 62 enables the user to easily realize which power switch is on or off. In addition, because the indicating member 60 has such a simple structure, it does not easily malfunctione.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An automatic power transfer switching mechanism for selectively connecting a first power supply or a second power supply to an electrical network, comprising:

a frame;

a first power switch configured to connect or disconnect the first power supply to the electrical network;

a second power switch configured to connect or disconnect the second power supply to the electrical network;

a push member rotatably disposed on the frame and rotatable with respect to a first axis, wherein the push member comprises a first push portion and a second push portion, and the first axis is located between the first push portion and the second push portion;

a linking mechanism connected to the push member; and a first driving source connected to the linking mechanism and rotating the push member about the first axis so as to move the first push portion to push the first power switch along a first direction and move the second push portion to push the second power switch along a second direction opposite to the first direction;

wherein the linking mechanism comprises:

a first linking member rotatably connected to the push member;

a second linking member rotatably connected to the first linking member, wherein the first driving source is connected to the second linking member and rotates the second linking member about a second axis so that the first linking member moves the push member to rotate the push member about the first axis; and wherein the second linking member comprises an eccentric wheel on which the first linking member rotatably holds, a center of the eccentric wheel is spaced from the second axis, and the first driving source rotates the eccentric wheel about the second axis.

2. The automatic power transfer switching mechanism as claimed in claim 1, wherein the first linking member comprises a link having an end holding an outer periphery of the eccentric wheel and another end pivoted to the push member, and the pivoting position of the link and the push member is located between the first push portion and the first axis.

3. The automatic power transfer switching mechanism as claimed in claim 1, further comprising a second driving source detachably joined to the second linking member.

4. The automatic power transfer switching mechanism as claimed in claim 3, wherein the second driving source comprises a rotatable rod having a center detachably joined to the second linking member.

5. The automatic power transfer switching mechanism as claimed in claim 3, wherein the second linking member comprises a main body and a fixing portion, the eccentric wheel and the fixing portion are disposed on opposite sides of the main body, and the fixing portion is fixed to the second driving source.

6. The automatic power transfer switching mechanism as claimed in claim 1, wherein the push member further comprises a rod, and the first push portion and the second push portion are formed as a depression and located on two opposite ends of the rod.

7. The automatic power transfer switching mechanism as claimed in claim 1, wherein the first driving source is fixed to the frame, and the first driving source comprises an electrical motor having an output shaft detachably joined to the second linking member and configured to rotate the second linking member about the second axis.

8. The automatic power transfer switching mechanism as claimed in claim 1, further comprising an indicating member comprising a first indicating end corresponding to the first push portion and a second indicating end corresponding to the second push portion, wherein the indicating member is fixed to the push member so that the indicating member is rotatable about the first axis along with the push member simultaneously; the first indicating end protrudes from the frame and the second indicating end is hidden in the frame when the first push portion pushes the first power switch to switch the first power supply on; the second indicating end protrudes from the frame and the first indicating end is hidden in the frame when the second push portion pushes the second power switch to switch the second power supply on.

9. The automatic power transfer switching mechanism as claimed in claim 8, wherein the frame comprises a supporting plate, and the indicating member and the push member are rotatably disposed on opposite sides of the supporting plate.

10. The automatic power transfer switching mechanism as claimed in claim 9, wherein the indicating member is fixed to the push member by a plurality of fasteners so that the indicating member is simultaneously rotatable about the first axis along with the push member, a plurality of slots are formed on the supporting plate to allow the fasteners extending through the supporting plate and joins the indicating member and the push member.

11. An automatic power transfer switching mechanism for selectively connecting a first power supply or a second power supply to an electrical network, comprising:

a frame;

a first power switch configured to connect or disconnect the first power supply to the electrical network;

a second power switch configured to connect or disconnect the second power supply to the electrical network;

a push member rotatably disposed on the frame and rotatable with respect to a first axis, wherein the push member comprises a first push portion and a second push portion, and the first axis is located between the first push portion and the second push portion;

a linking mechanism connected to the push member; and a first driving source connected to the linking mechanism and rotating the push member about the first axis so as to move the first push portion to push the first power switch along a first direction and move the second push portion to push the second power switch along a second direction opposite to the first direction; and an indicating member comprising a first indicating end corresponding to the first push portion and a second indicating end corresponding to the second push portion, wherein the indicating member is fixed to the push member so that the indicating member is rotatable about the first axis along with the push member simultaneously; the first indicating end protrudes from the frame and the second indicating end is hidden in the frame when the first push portion pushes the first power switch to switch the first power supply on; the second indicating end protrudes from the frame and the first indicating end is hidden in the frame when the second push portion pushes the second power switch to switch the second power supply on.

12. The automatic power transfer switching mechanism as claimed in claim 11, wherein the linking mechanism comprises:

a first linking member rotatably connected to the push member;

a second linking member rotatably connected to the first linking member, wherein the first driving source is connected to the second linking member and rotates the second linking member about a second axis so that the first linking member moves the push member to rotate the push member about the first axis.

13. The automatic power transfer switching mechanism as claimed in claim 12, wherein the second linking member comprises an eccentric wheel on which the first linking member rotatably holds, a center of the eccentric wheel is spaced from the second axis, and the first driving source rotates the eccentric wheel about the second axis.

14. The automatic power transfer switching mechanism as claimed in claim 13, wherein the first linking member comprises a link having an end holding an outer periphery of the eccentric wheel and another end pivoted to the push member, and the pivoting position of the link and the push member is located between the first push portion and the first axis.

15. The automatic power transfer switching mechanism as claimed in claim 14, further comprising a second driving source detachably joined to the second linking member.

16. The automatic power transfer switching mechanism as claimed in claim 11, wherein the frame comprises a supporting plate, and the indicating member and the push member are rotatably disposed on opposite sides of the supporting plate.

17. The automatic power transfer switching mechanism as claimed in claim 16, wherein the indicating member is fixed to the push member by a plurality of fasteners so that the indicating member is simultaneously rotatable about the first axis along with the push member, a plurality of slots are formed on the supporting plate to allow the fasteners extending through the supporting plate and joins the indicating member and the push member.

18. The automatic power transfer switching mechanism as claimed in claim 17, wherein the first linking member and the second linking member are on an identical side of the supporting plate.

19. The automatic power transfer switching mechanism as claimed in claim 18, wherein the first driving source and the push member are on an identical side of the supporting plate.

* * * * *